US005456460A

United States Patent [19]

Larsen

[11] Patent Number: 5,456,460

[45] Date of Patent: Oct. 10, 1995

[54] BASEBALL BASE GROUND SOCKET COVER

[76] Inventor: Todd R. Larsen, P.O. Box 59, Elk Point, S. Dak. 57025

[21] Appl. No.: 268,493

[22] Filed: Jun. 30, 1994

[51] Int. Cl.[6] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,259,610 | 10/1941 | Bryson | 273/25 |
| 2,405,492 | 8/1946 | Corbett | 273/25 |
| 2,624,584 | 1/1953 | Corbett | 273/25 |
| 4,634,120 | 1/1987 | Hall | 273/25 |
| 5,186,119 | 2/1993 | Hlavin | 273/25 |

*Primary Examiner*—Theatrice Brown

[57] ABSTRACT

A safety and guard plug for a ground socket such as those used for placement of baseball base markers. The plug is adapted to fill the ground socket and to be held in place to resist removal except by use of the proper tools.

4 Claims, 1 Drawing Sheet

BASEBALL BASE GROUND SOCKET COVER

BACKGROUND AND SUMMARY OF THE INVENTION

This invention relates to devices adapted to anchor base markers for use on baseball and softball diamonds or similar devices using sockets set into the ground. The plug of the invention is adapted to fill the socket and cover it to prevent filling of the socket by water or dirt and includes a cover to guard against injury by the hard metal walls of the ground socket.

Currently a substantial preparation of all baseball and softball diamonds use removable base markers which are set into ground sockets. The socket includes a tubular metal member set into a hole in the surface of the diamond. Usually that hole is of square or rectangular cross section so that the base marker will be properly oriented with the sides of the marker along the base line and not diagonal to those lines.

The base marker includes a post extending downwardly from the base and extending into the socket, but being readily removable therefrom. Thus, when the base marker is removed, an open socket remains at ground level. This socket is in position to be easily filled by ground water, sand, dirt or any material on adjacent the ground.

By the present invention, a guard device is provided to keep such material out of the socket and to cover the edges of the tubular socket members so that persons on the grounds are protected from those edges. The device is built so that the guard is not readily removable without using a proper tool.

DESCRIPTION

Figure 2:
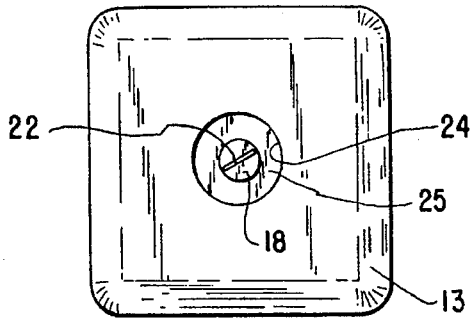
FIG. 2 is a top plan view of the plug removed from the socket.
Figure 3:
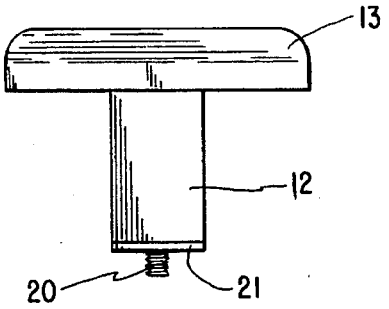
FIG. 3 is an elevational view of the plug as in FIG. 2.
Figure 4:
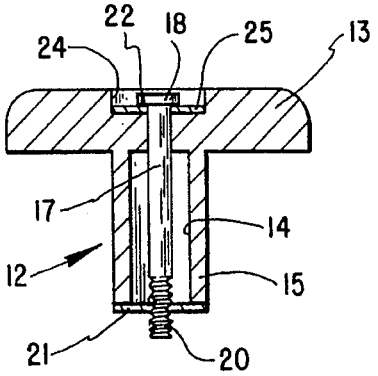
FIG. 4 is a sectional view of the plug of FIG. 2.
Figure 5:
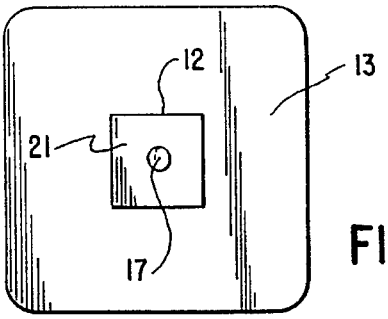
FIG. 5 is a bottom plan view of the plug.
Figure 1:
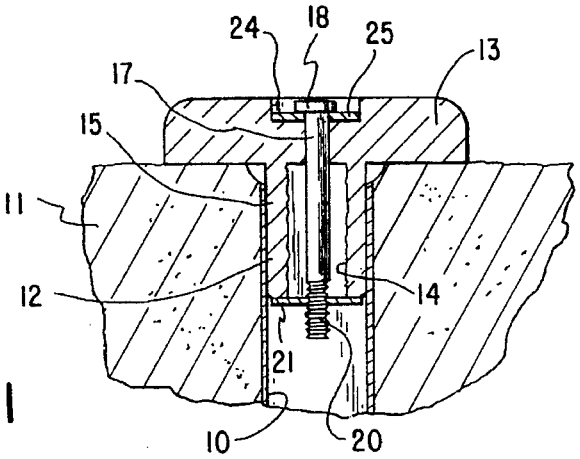
FIG. 1 is a medial sectional view of the plug in place in a socket in the ground.

Briefly, this invention comprises a protective device adapted to keep a base-locating socket clean and to avoid injury to anyone inadvertently coming into contact with the walls of the socket. More specifically and referring to the figures, the protector is used in connection with a socket formed in the ground for the purpose of holding a base marker for a baseball or softball diamond or some similar marker.

Customarily the infield bases in a baseball or softball diamond are marked with devices having a peg on their under side. The three infield bases use a padded upper member. The peg is placed into a square tube 10 or similar socket-defining member sunk into a hole in the surrounding earth 11. Thus, the tube 10 defines a socket adapted to hold the base member.

When the diamond is not in use, the base-markers are removed leaving an open socket which collects rainwater, sand, earth or other materials. The walls of the tube 10 may also be exposed by erosion of the earth surrounding the open end. When this happens the hard walls of the tube 10 expose a hazard to people—particularly children playing in the area.

In order to protect both the openness of the socket and the safety of people, the present invention proposes a cover and plug as shown in the figures. The plug includes a peg 12 of a size and shape similar to that on the base marker. Thus the plug 12 fits into the tube 10. A cover 13 is formed integrally with the plug 12 and is of sufficient size to cover completely the opening of the tube 10. It is preferred to have ample coverage so that the tube will always be completely closed and so that the ends of the tube will be fully covered.

Because simply dropping the plug 12 into the socket does not insure its placement, means are provided to anchor the plug in place. This means includes the formation of the plug 12 with a hollowed out space 14. This form leaves relatively flexible walls 15 in the material of the plug. That material is preferably a rubber-like material such as ethylene propylene diener monomer (EPDM) which would be used for both the plug and the cover.

The method of anchoring the plug, then, includes a bolt 17 extending from its head 18 through a hole in the cover 13, through the space 14 in the plug and to a threaded end 20. The end is threaded into a threaded washer 21 adapted to cover the end of the plug. The head 18 may be formed with a screw-driver slot 22 or any other form adapted to receive a tool to tighten or loosen the threads. Such form might include any type of socket arrangement such as a "Phillips head", a hexagonal socket for an Allen wrench, or the head may be formed with exterior flat surfaces in square or hexagonal forms on which an ordinary wrench or plier might be used. The purpose is simply to be able to tighten the bolt 17 so as to cause expansion of the walls 15 and to press those walls forcibly against the inner surface of the tube 10. Because of the pressure on the ends of those walls there will be a tendency for the walls to expand, pressing them against the tube 11. The friction thus produced makes it unlikely that there will be any inadvertent removal of the plug.

Preferably the head 18 of the bolt 17 is recessed into an indented area 24 of the cover 13. A washer 25 may also be used at this end to spread the force over a broader area and to enhance the expansion of the walls 15 of the plug into the tube 10.

It is recognized that even the device shown is not fully secure from theft or the like. More elaborate means might be taken to lock closed a cover over the indented area 24 or to lock the bolt 17 to prevent its being turned. However, the device as shown and described will be helpful in protecting the socket for the peg on a base marker from being filled, and the cover 13 will be effective to guard against accidental injury by the walls of the tube 10. Many playgrounds and other ball diamonds are in relatively secure areas so that the device is very useful in such settings, and further security may be unnecessary.

I claim as my invention:

1. A baseball base ground socket cover comprising a tubular liner for said opening, plug means having a peg adapted to substantially fill said tubular liner, said plug means also including a cover member attached to said peg and of a size to overlap and guard the walls of said tubular liner, said peg having a central hollow space thus defining peg walls between the exterior of said peg and said hollow space, said peg walls being flexible, and means to exert pressure on said peg walls to cause expansion thereof and to exert pressure on the interior of said tubular liner.

2. The guard socket cover of claim 1 in which said means to exert axial pressure includes a threaded bolt extending through said cover member and said hollow space, means engageable with said peg walls opposite said cover member, said bolt being threadably engaged with said means engageable with said peg walls whereby tightening said bolt will cause expansion of said peg walls against the interior of said tubular liner.

3. The guard socket cover of claim 2 in which said bolt includes a head at one end and a threaded section at another end, said cover member being formed with an indented section, said head being normally disposed in said indented section.

4. The guard socket cover of claim 2 in which said means engageable with said plug walls is a washer engageable with said walls, said washer being threadably engaged with said bolt.

* * * * *